US007484378B2

(12) United States Patent
Allen et al.

(10) Patent No.: US 7,484,378 B2
(45) Date of Patent: Feb. 3, 2009

(54) COOLING SYSTEM AND METHOD FOR COOLING A HEAT PRODUCING SYSTEM

(75) Inventors: David J. Allen, Gladstone, MI (US); Kim S. Aerts, Powers, MI (US); Bradley O. Burch, Gladstone, MI (US); Matthew W. Cardwell, Rock, MI (US); Kurt J. Wasilewski, Bark River, MI (US)

(73) Assignee: EMP Advanced Development, LLC, Escanaba, MI (US)

( * ) Notice: Subject to any disclaimer, the term of this patent is extended or adjusted under 35 U.S.C. 154(b) by 492 days.

(21) Appl. No.: 11/125,653

(22) Filed: May 10, 2005

(65) Prior Publication Data

US 2006/0254292 A1 Nov. 16, 2006

(51) Int. Cl.
*G05D 23/32* (2006.01)
*F25D 17/00* (2006.01)

(52) U.S. Cl. ..... 62/158; 62/179; 62/180

(58) Field of Classification Search ..... 62/179, 62/180, 181, 183, 185, 186, 157, 158, 231; 236/35

See application file for complete search history.

(56) References Cited

U.S. PATENT DOCUMENTS

| | | | | |
|---|---|---|---|---|
| 1,968,874 | A | 8/1934 | Cobb | |
| 4,590,892 | A | 5/1986 | Nose et al. | |
| 4,651,922 | A | 3/1987 | Noba | |
| 4,797,600 | A | 1/1989 | Savage et al. | |
| 5,816,053 | A * | 10/1998 | Huether | 62/65 |
| 5,901,672 | A | 5/1999 | Suzuki et al. | |
| 6,070,560 | A | 6/2000 | Johnston et al. | |
| 6,463,891 | B2 | 10/2002 | Algrain et al. | |
| 6,840,743 | B2 | 1/2005 | Herke et al. | |
| 2003/0183433 | A1 | 10/2003 | MacKelvie | |
| 2005/0006048 | A1 | 1/2005 | Vuk | |
| 2005/0028756 | A1 | 2/2005 | Santanam et al. | |
| 2005/0066914 | A1 | 3/2005 | Avery, Jr. et al. | |
| 2005/0199369 | A1 * | 9/2005 | Chen | 165/80.3 |
| 2006/0169789 | A1 * | 8/2006 | Barsun et al. | 236/49.3 |

FOREIGN PATENT DOCUMENTS

| | | |
|---|---|---|
| EP | 0 004 448 A1 | 10/1979 |
| JP | 9322387 | 12/1997 |

OTHER PUBLICATIONS

International Search Report, mailing date of Aug. 3, 2007, 1 page.

* cited by examiner

*Primary Examiner*—Marc E Norman
(74) *Attorney, Agent, or Firm*—Brooks Kushman P.C.

(57) ABSTRACT

A cooling system for a heat producing system includes a heat exchanger in fluid communication with the heat producing system. The heat exchanger is configured to receive a temperature control fluid therethrough. A first fan is operable in a first rotational direction to move air through the heat exchanger in a first direction. A second fan is disposed radially adjacent to the first fan, and is operable in a second rotational direction opposite the first rotational direction to move air through the heat exchanger in the first direction. A control system, including at least one controller, is provided for controlling operation of the fans.

16 Claims, 4 Drawing Sheets

COOLING SYSTEM AND METHOD FOR COOLING A HEAT PRODUCING SYSTEM

BACKGROUND OF THE INVENTION

1. Field of the Invention

The present invention relates to a cooling system and method for cooling a heat producing system.

2. Background Art

Vehicles today are under an ever increasing demand to do more in less space. For example, an engine in a large commercial vehicle will typically provide torque to power the vehicle, and will also provide power to a variety of vehicle subsystems. Some of the subsystems may be directly driven by the engine through a mechanical link, while others may be operated by electrical power received from a generator, which itself is connected to the engine. As the number of these vehicle subsystems increases, so to does the demand on the engine. Therefore, there is a need to ensure an adequate cooling system for the engine so that it does not overheat or cause damage to vehicle components in close proximity to it. In addition, increasingly stringent emissions requirements can place additional demands on an engine cooling system, as the overall thermal output of the engine is closely managed to help meet the emissions requirements.

The increasing number of requirements placed on the engine can be the cause of increased size and complexity of the engine and its subsystems, including its thermal management system. Of course, many of these same concerns are present in other heat producing systems, for example a fuel cell or an engine used to drive an electrical generator, just to name two. In addition, other systems within a vehicle—i.e., systems other than the engine—may also require thermal management, further increasing the size and complexity of the thermal management system.

A conventional thermal management system may include one or more heat exchangers which are configured to facilitate heat dissipation from a temperature control fluid which receives heat from one or more heat producing systems. For example, in the case of a vehicle, a heat exchanger may be in the form of a radiator which has an engine coolant flowing therethrough. The coolant flows around the engine, absorbing heat from the engine, and then flows through the radiator where heat from the coolant is dissipated to the ambient air. Typically, one or more fans are used to move air through the radiator to increase the heat dissipation from the engine coolant to the ambient air. In the case of large vehicles, or other systems which produce a large amount of heat, it may be desirable to use a plurality of fans to move air through the radiator or other heat exchanger, rather than one large fan. Accordingly, it would be desirable to have a cooling system for a heat producing system, such as an engine in a vehicle, which uses a plurality of fans to efficiently move air through one or more heat exchangers to facilitate thermal management of the heat producing system.

SUMMARY OF THE INVENTION

The present invention provides a cooling system for a heat producing system, including a heat exchanger in fluid communication with the heat producing system and configured to receive a temperature control fluid therethrough. A first fan is operable in a first rotational direction to move air through the heat exchanger in a first direction. A second fan is disposed radially adjacent to the first fan, and is operable in a second rotational direction opposite the first rotational direction to move air through the heat exchanger in the first direction. A control system is provided for controlling operation of the fans, and includes at least one controller.

The invention also provides a cooling system for a heat producing system, including a heat exchanger in fluid communication with the heat producing system. The heat exchanger is configured to receive a temperature control fluid therethrough. A plurality of fans are provided, such that each of the fans is disposed radially adjacent to at least one other of the fans. At least one of the fans is operable in a first rotational direction to move air through the heat exchanger in a first direction. At least one other of the fans is operable in a second rotational direction opposite the first rotational direction to move air through the heat exchanger in the first direction. A control system is also provided for controlling operation of the fans; the control system includes at least one controller.

The invention further provides a cooling system for a heat producing system, including a heat exchanger in fluid communication with the heat producing system and configured to receive a temperature control fluid therethrough. A plurality of fans are provided, and each of the fans is disposed radially adjacent to at least one other of the fans. Each of the fans is operable to move air through the heat exchanger to facilitate cooling of the temperature control fluid flowing therethrough. A control system, which includes at least one controller, is configured to control operation of the fans such that each of the fans is started separately from any other of the fans. This reduces the power consumption associated with starting a plurality of the fans simultaneously.

The invention also provides a method for cooling a heat producing system utilizing a heat exchanger and a plurality of fans. Each of the fans is disposed radially adjacent at least one other of the fans for moving air across the heat exchanger. The method includes operating a first one of the fans in a first rotational direction to move air through the heat exchanger in a first direction. A second one of the fans is disposed radially adjacent the first fan, and is operated in a second rotational direction opposite the first rotational direction to move air through the heat exchanger in the first direction.

DETAILED DESCRIPTION OF THE PREFERRED EMBODIMENT(S)

Figure 1:
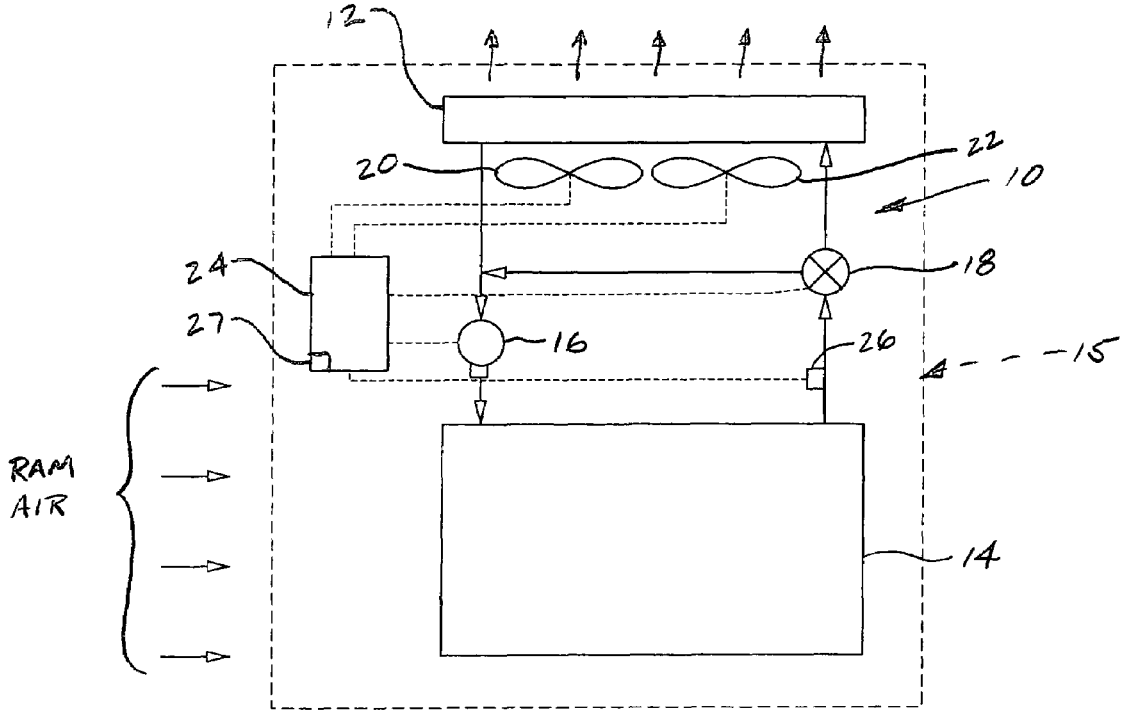
FIG. 1 is schematic representation of a cooling system in accordance with one embodiment of the present invention, the cooling system providing cooling to a heat producing system.

FIG. 1 shows a cooling system 10 in accordance with one embodiment of the present invention. The cooling system 10 includes a heat exchanger, or radiator 12 which is in fluid communication with an engine 14, used to propel a vehicle 15 shown in FIG. 1. It is understood that a cooling system, such as the cooling system 10, can be used with other heat producing systems, including other vehicle systems, as well as non-vehicle systems. A pump 16 is used to pump a temperature control fluid, such as a mixture of glycol and water, or some other cooling medium, around the engine 14 and through the radiator 12. A valve 18 is provided so the fluid can bypass the radiator 12 during certain conditions, such as a cold engine start. Fans 20, 22 are operable to move air through the radiator 12 to facilitate cooling of the temperature control fluid.

A control system, shown in FIG. 1 as controller 24, is used to control operation of the pump 16, the valve 18, and the fans 20, 22. It is understood that operation of one or more of these devices could be controlled by a separate controller or controllers, which could communicate with each other, for example, through a controller area network (CAN). Also shown in FIG. 1, a temperature sensor 26 is used to monitor the temperature of the temperature control fluid as it leaves the engine 14, thereby providing the controller 24 with an indication of how much cooling is required. Alternatively, one or more temperature sensors may sense engine block temperature or an average of engine block temperature and the temperature of the temperature control fluid. Moreover, some other related temperature, such as oil temperature may used alone, or as a combined average with other temperatures.

Also shown associated with the controller 24 is a temperature sensor 27, used for monitoring the temperature of the controller 24 itself. Information from the sensor 27 can be used in a thermal overload protection strategy integrated into the controller 24. For example, if the vehicle 15 is operating such that the engine 14 is producing a large amount of heat, and the temperature of the controller 24 goes beyond a first predetermined controller temperature, the controller 24 will shut down. A signal will be provided to an operator of the vehicle 15, since the pump 16, the valve 18, and the fans 20, 22 will no longer be operational. It may be rare that the controller 24 goes beyond the first predetermined controller temperature while the vehicle 15 is operating; for example, ram air may provide some cooling to the controller 24. In addition, as discussed more fully below, a controller, such as the controller 24, can be placed in the path of the air flow generated by the fans in a cooling system, thereby helping to keep the controller temperature down.

One situation in which the temperature of the controller 24 may become undesirably high, is during a hot soak of the under-hood components of the vehicle 15, which can occur after the vehicle 15 is shut down. During such a hot soak condition, the controller 24 may exceed the first predetermined controller temperature and dwell there. With only the thermal protection strategy described above in place, the engine 14 could be vulnerable if the vehicle 15 is restarted during this high temperature state. Therefore, the controller 24 is also configured to operate for a predetermined period of time after the vehicle 15 is started, regardless of the controller temperature. This allows the cooling system 10 to function, at least for the predetermined period of time, thereby providing the required cooling to the engine 14. During the predetermined period of time, it is likely that the temperature of the controller 24 will drop below the first predetermined controller temperature, at which point, it will function normally. If, however, the predetermined period of time elapses, and the controller 24 is still above the first predetermined controller temperature, it will shut down in accordance with the thermal protection strategy.

As shown in FIG. 1, the radiator 12 is above the engine 14, while the front of the vehicle 15 is to the left of the engine 14. This is indicated by the direction of the ram air shown on the left side of FIG. 1. Having the cooling system 10 located above the engine 14 may provide a number of advantages, including relatively uninhibited movement of the ram air over the engine 14 to aid in heat dissipation from the engine 14. Moreover, having the radiator 12 located above the engine 14, allows the fans 20, 22 to be operated in a "push mode". That is, the fans 20, 22 can be rotated such that air is drawn away from the engine 14 and blown through the radiator 12, as indicated by the directional arrows above the radiator 12. The air that is blown through the radiator 12 can escape the engine compartment through any convenient opening, such as air vents in a vehicle hood. Although the fans 20, 22 are both configured to push air through the radiator 12, one method of operating the fans 20, 22 is to rotate each of them in opposite directions. As explained more fully below, this counter rotation can help reduce interaction between the air flows generated by the two fans, which can be detrimental to the efficiency of the cooling system 10.

Figure 2:
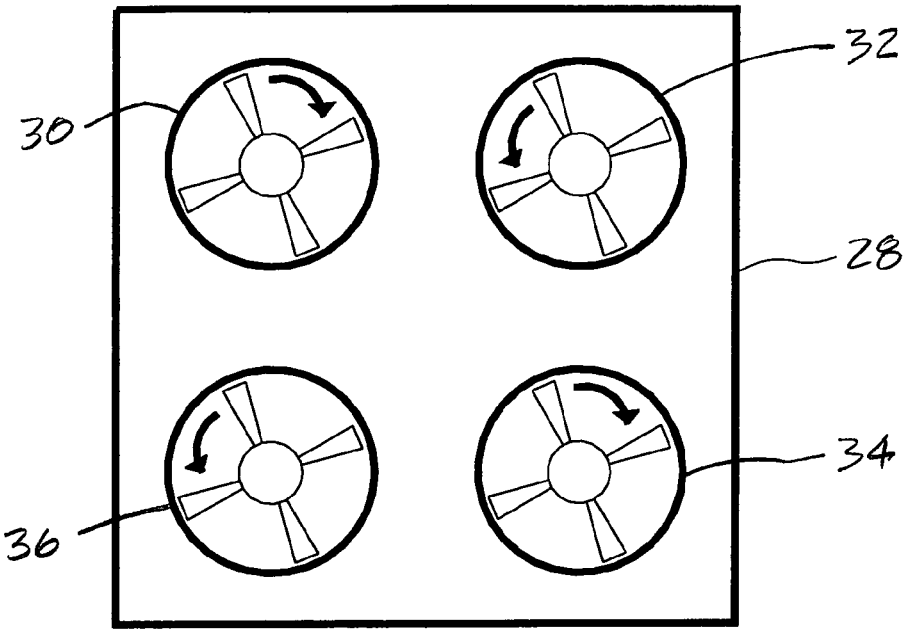
FIG. 2 is a schematic representation of a fan and heat exchanger assembly in accordance with an embodiment of the present invention.

As noted above, a cooling system, such as the cooling system 10 shown in FIG. 1, which uses the fans 20, 22 to push air through the radiator 12, may provide advantages over a system which uses fans to pull air through a heat exchanger. Pushing air through a heat exchanger may, however, require that consideration be given to the effect that the air flow generated by one fan has on the air flow generated by an adjacent fan. For example, FIG. 2 shows a heat exchanger 28 which may be used in a cooling system in accordance with the present invention. Associated with the radiator 28 are four fans 30, 32, 34, 36, each of which is disposed radially adjacent to at least one other of the fans. As shown in FIG. 2, the first and third fans 30, 34 are configured to rotate in a clockwise direction, while the second and fourth fans 32, 36 are configured to rotate in a counterclockwise direction. The direction of rotation of the fans is easily controlled when the fans are operated by electric motors, which are connected to one or more controllers, such as the arrangement shown in FIG. 1.

If each of fans 30, 32, 34, 36, shown in FIG. 2, were operated to rotate in the same direction, the interaction of the air flows between any one of the fans and one or more of the fans that are radially adjacent to it, could be detrimental to the mass flow rate of the air moving through the heat exchanger 28, thereby reducing the efficiency of the cooling system in which it is used. This is because fans which are radially adjacent to each other, and which rotate in the same direction, can create a vortex of air between them. This vortex moves air in a direction opposite to the air flows generated by the fans. This, in turn, reduces the mass air flow through a heat exchanger, such as the heat exchanger 28. It is understood that although the fans 30, 34 are configured to rotate in a direction opposite to that of the fans 32, 36, each of the fans will be configured such that it moves air through the heat exchanger 28 in the same direction. That is, each of the fans 30, 32, 34, 36 are configured to push air through the heat exchanger 28, just as the fans 20, 22 are both configured to push air through the radiator 12 as shown in FIG. 1.

Figure 3:
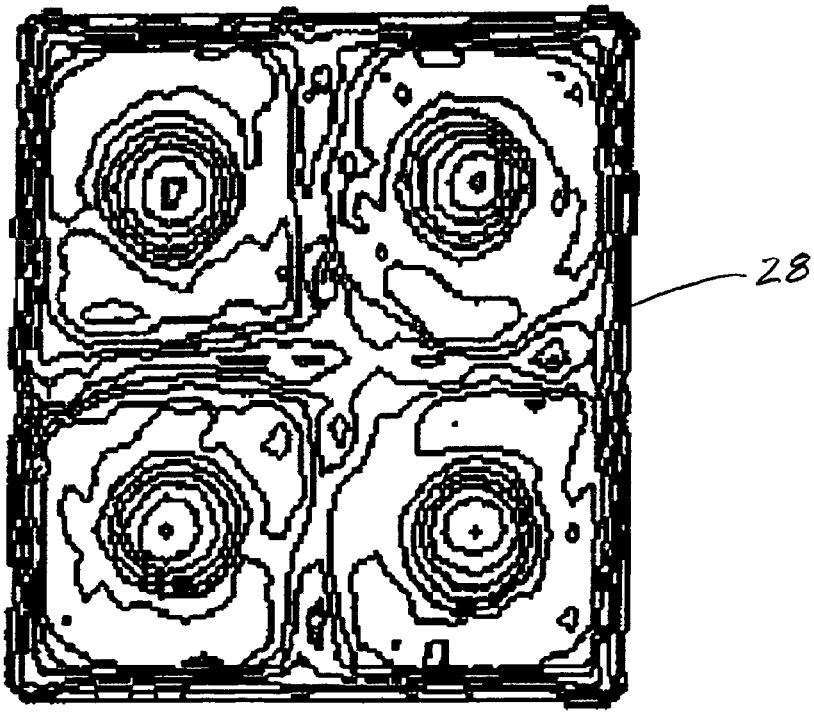
FIG. 3 is a velocity contour of a software model of the fan and heat exchanger assembly shown in FIG. 2.

FIG. 3 shows a velocity contour for a fan and heat exchanger arrangement, such as shown in FIG. 2. The velocity contour shown in FIG. 3 was generated with computational fluid dynamics (CFD) software. The model that was used, resembled the model shown in FIG. 2 in that the fans on each diagonal rotated in the same direction, while the fans which were directly beside each other, or directly above or below each other, rotated in opposite directions. As shown in FIG. 3, there is very little interaction between the flows of each of the four fans.

Figure 4:
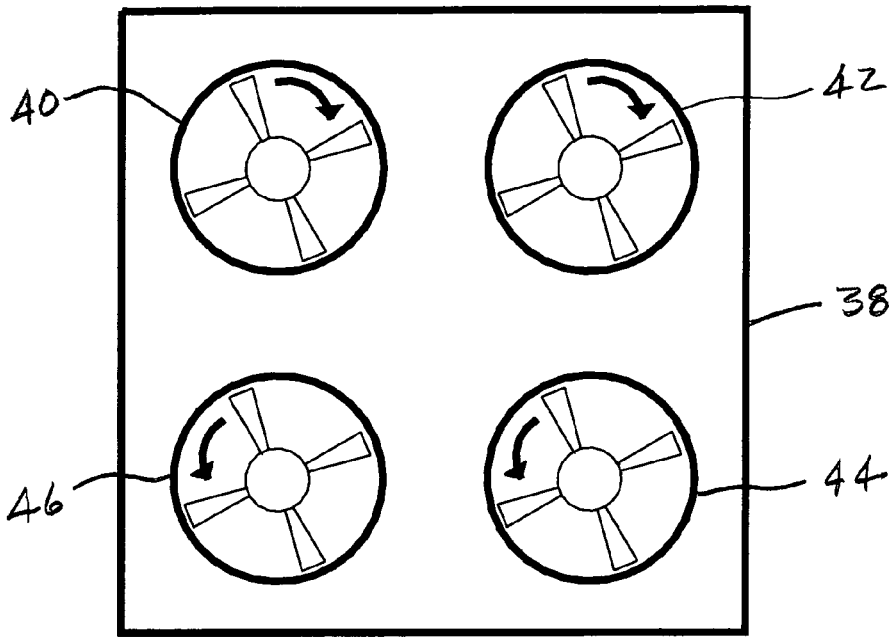
FIG. 4 is a fan and heat exchanger assembly in accordance with another embodiment of the present invention.
Figure 5:
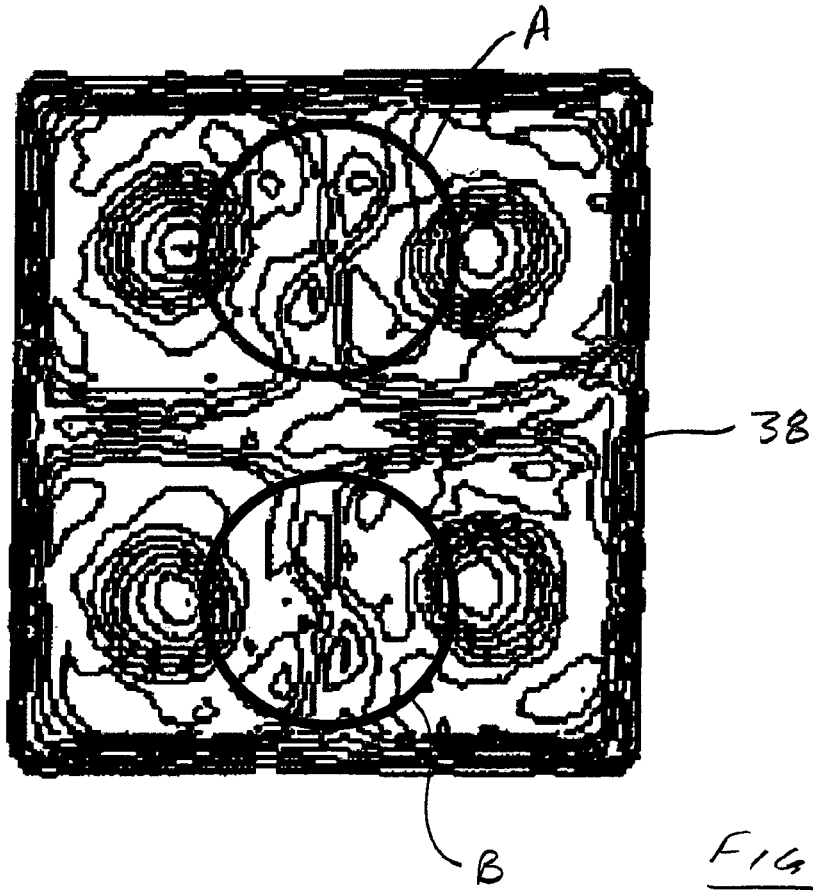
FIG. 5 is a velocity contour of a software model of the fan and heat exchanger assembly shown in FIG. 4.

FIG. 4 shows a heat exchanger 38 and associated fans 40, 42, 44, 46. Although all of the fans 40, 42, 44, 46 do not rotate in the same direction, the fan 40 rotates in the same direction as the fan 42, while the fan 44 rotates in the same direction as the fan 46. It is understood that despite the difference in rotation, each of fans 40, 42, 44, 46 are used to push air in the same direction through the heat exchanger 38. Because the fan 40 is in close proximity to the fan 42, and they both rotate in the same direction, it may be expected that some flow interaction would be present; this would also be expected of the air flows from the fans 44, 46. This expectation is confirmed by the velocity contour shown in FIG. 5. FIG. 5 shows a velocity contour generated using CFD software modeling a fan and heat exchanger arrangement such as shown in FIG. 4. As expected, detail A shows flow interaction between the two upper fans, and detail B shows flow interaction between the two lower fans.

Although the flow interaction shown in details A and B in FIG. 5 may be less desirable than the virtual absence of any flow interaction, as shown in the arrangement modeled in FIG. 3, the interaction shown in FIG. 5 is still relatively small. This is because the fans 40, 42 rotate in the opposite direction of the fans 44, 46. Thus, even the fan and heat exchanger arrangement shown in FIG. 4 provides advantages over conventional arrangements in which each of the fans rotates in the same direction, and wherein an induced flow vortex can be generated, limiting the air flow through the heat exchanger.

Figure 6:
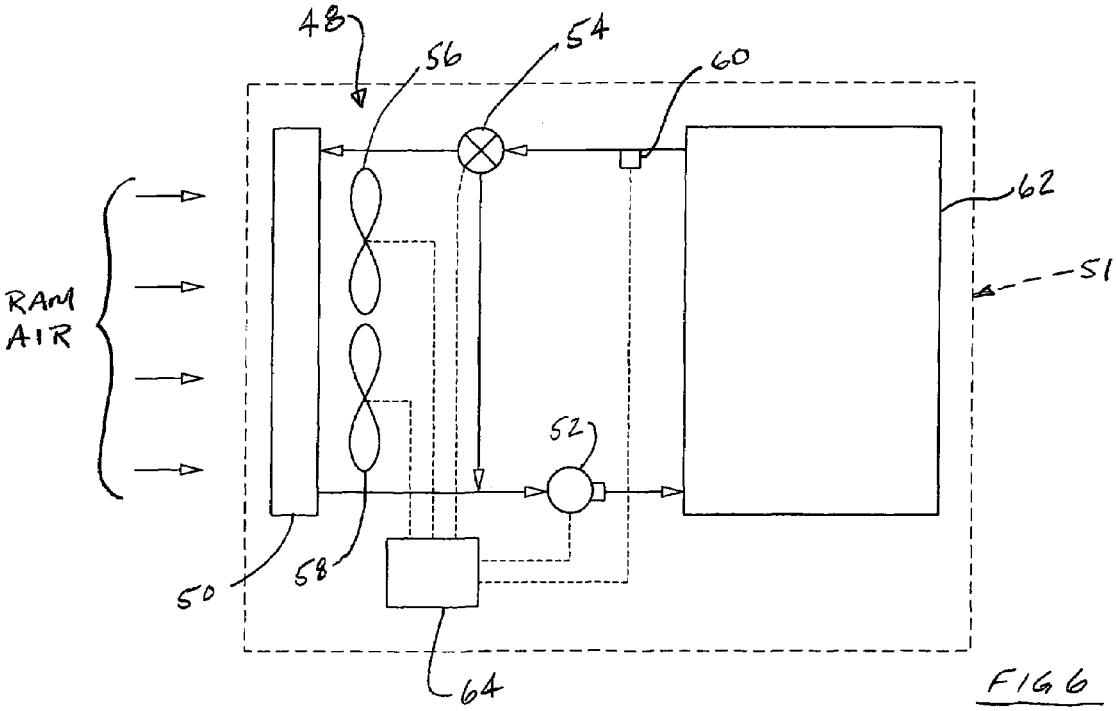
FIG. 6 is a schematic representation of a cooling system in accordance with an alternative embodiment of the present invention, the cooling system providing cooling to a heat producing system.

Turning to FIG. 6, a cooling system 48 in accordance with an embodiment of the present invention is shown. The cooling system 48 includes a heat exchanger, or radiator 50, a pump 52 for pumping a temperature control fluid through the radiator 50, a bypass valve 54, and fans 56, 58. In addition, a temperature sensor 60 is used to sense the temperature of the temperature control fluid as it leaves a heat producing system, such as an engine 62. As with the cooling system 10, shown in FIG. 1, the fans 56, 58 are controlled by electric motors which are connected to a control system, shown in FIG. 6 as controller 64. The pump 52, the valve 54, and the temperature sensor 60 are also connected to the controller 64. Alternatively, the valve 54 could be thermostatically controlled, rather than electronically controlled by the controller 64. Similarly, the pump 52 could be mechanically driven, for example by the engine 62.

As shown in FIG. 6, the radiator 50 is disposed toward the front of a vehicle 51, only a portion of which is shown. This is indicated by the direction of the ram air shown on the left side of the FIG. 6. As noted above, it may be desirable to push, rather than pull, air through a heat exchanger, such as the radiator 50. Under some circumstances, however, it may be better to pull the air through a heat exchanger. For example, if the ram air speed is at or above a first predetermined speed, it may be beneficial to operate the fans 56, 58 to pull air through the radiator 50, so that the fans 56, 58 are working with, rather than against, the direction of the ram air. This may be particularly true when the vehicle 51 is traveling at a relatively high speed. Conversely, if the vehicle 51 is moving at a relatively low speed, such that the speed of the ram air is below the first predetermined speed, it may be beneficial to operate the fans 56, 58 to push air through the radiator 50, as described above.

Operation of the fans 56, 58, including their rotational direction, can be controlled by the controller 64. Because it is contemplated that the fans 56, 58 may, under certain conditions, push air through the radiator 50, the fans 56, 58 can be configured to rotate in opposite directions to avoid inefficient flow interaction. Thus, one method of operating the fans 56, 58 is to rotate each of them in opposite directions such that each of the fans 56, 58 pulls air through the radiator 50 when the ram air speed is at or above the first predetermined speed. In addition, each of the fans 56, 58 can be operated with its respective rotation reversed such that both of the fans 56, 58 push air through the radiator 50 when the ram air speed is below the first predetermined speed. In addition to the benefits described above associated with pushing air through a heat exchanger, having the fans 56, 58 push air through the radiator 50 may help to dissipate additional heat, as each of the fans 56, 58 pull air away from the engine 62 and exhaust the air outside the vehicle 51.

Figure 7:
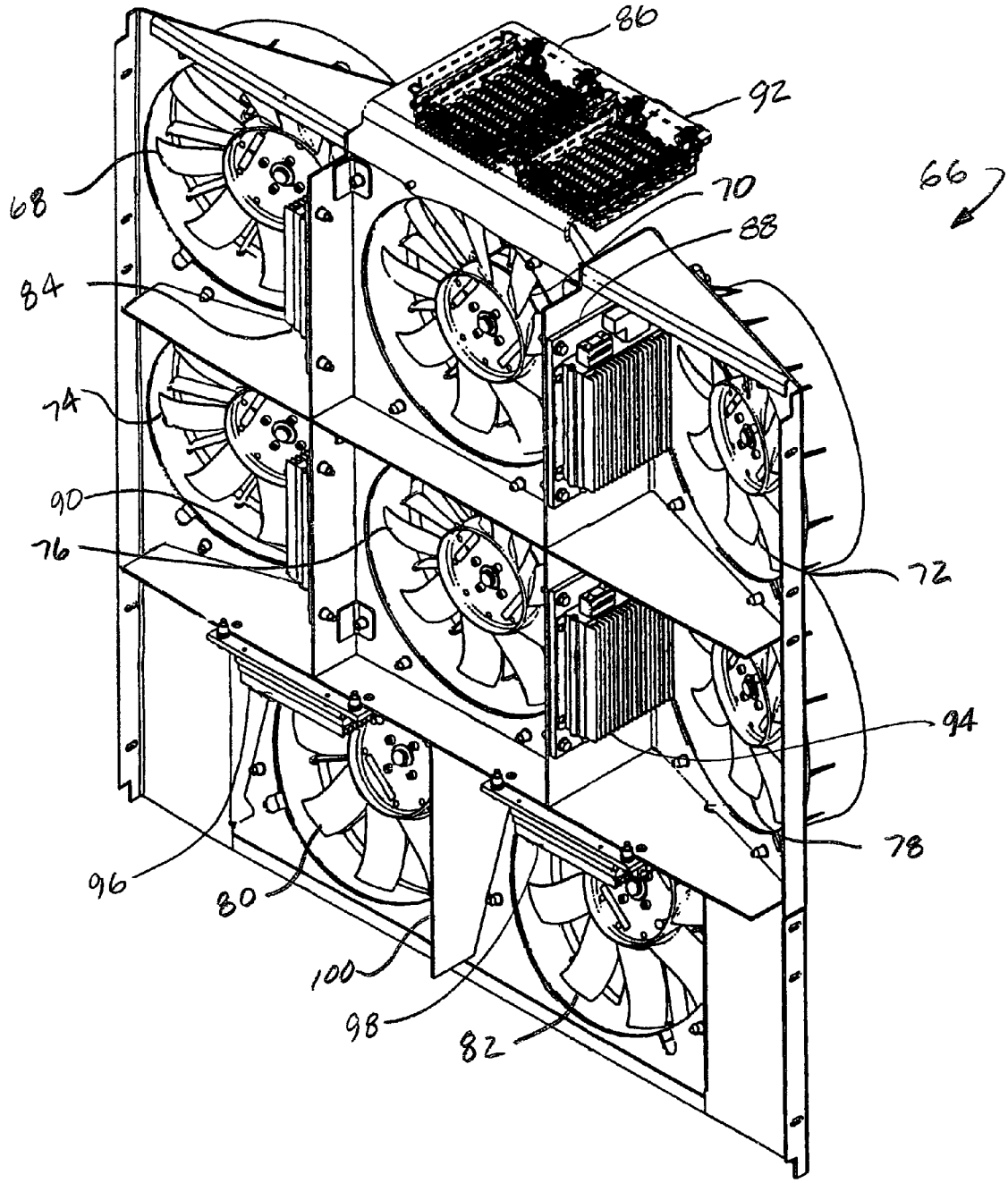
FIG. 7 is a fan and shroud assembly which makes up a portion of a cooling system illustrating another embodiment of the present invention.

Although the cooling systems described above are shown having two or four fans which are operable to move air through a respective heat exchanger, it is understood that in some applications more than four fans may be required. For example, in a large commercial vehicle, it may be necessary to have a heat exchanger with a very large surface area to ensure adequate cooling of the vehicle engine and/or other vehicle systems. Moreover, some vehicles may include adjacent heat exchangers, or an integrated heat exchanger serving multiple heat producing systems via corresponding coolant loops. Each adjacent heat exchanger, or separate portion of an integrated heat exchanger may have one or more fans adjacent to each other—see, e.g.,U.S. Pat. No. 7,406,835, issued on 5 Aug. 2008, which is hereby incorporated herein by reference. FIG. 7 shows a fan and shroud assembly 66 that could be used with a large heat exchanger. The assembly 66 includes fans 68, 70, 72, 74, 76, 78, 80, 82, each of which is controlled by a respective controller 84, 86, 88, 90, 92, 94, 96, 98. Having individual controllers provides a convenient way to individually control each of the fans 68, 70, 72, 74, 76, 78, 80, 82. It is understood, however, that the present invention contemplates the use of a single controller to control multiple fans.

As shown in FIG. 7, most of the controllers are mounted adjacent a respective fan on a portion of the shroud. Two of the controllers 86, 92, however, are mounted at the top of the fan and shroud assembly 66, so as to avoid having two controllers mounted directly opposite each other on a portion of a shroud wall. This helps to avoid undesirable heat buildup that could be generated with two controllers in close proximity to each other. With the exception of the controllers 86, 92, the remaining controllers are disposed within the air flow path of a respective fan, which helps to keep the controller cool when the fan is in use. Moreover, at least a portion of the shrouds can be made from a heat conductive material so that when a controller is mounted to it, it dissipates heat into the shroud. Each of the controllers 84, 86, 88, 90, 92, 94, 96, 98 may be part of an integrated control system which controls not only operation of the fans, but also operation of valves, and/or pumps, such as the valve 18 and the pump 16 shown in FIG. 1.

Providing each of the fans 68, 70, 72, 74, 76, 78, 80, 82 with individualized control, as shown in FIG. 7, allows each of the fans to be operated independently from each of the other fans. One advantage to a cooling system providing this type of fan control, is that it can reduce overall power use, and eliminate a large current draw associated with fan startup. For example, in some high temperature situations, it may be necessary to maximize air flow through a heat exchanger, and in such a case, all eight fans 68, 70, 72, 74, 76, 78, 80, 82 may be required to be in operation simultaneously. Conversely, there may be situations in which less cooling is required, in which case, a fewer number of the fans can be operated. This provides an energy savings, by only operating those fans which are necessary to provide the required amount of cooling.

Even if it is required that all eight fans operate simultaneously, each of the fans 68, 70, 72, 74, 76, 78, 80, 82 can be started individually. For example, the fan 68 may be started first, while the second fan 70 is started only after the first fan 68 has been operating for some predetermined time. The controllers 84, 86 may be configured to communicate with each other, for example over a CAN so that the fan 70 is only started after the fan 68 has been operating for the predetermined time. Alternatively, operation of the second fan 70 does not need to be predicated on having the first fan 68 operate for a predetermined time; rather, it may be desirable to merely verify that the fan 68 is operating prior to starting the fan 70. In such a case, the controller 86 may receive a signal from the controller 84 verifying that the fan 68 is operating. After receipt of such a signal, the controller 86 can than start the fan 70. The controller 84 can verify that the fan 68 is operating by any method effective to convey the information. For example, the fan 68 may signal the controller 84 directly, or the controller 84 may use a determination of voltage or current to verify that the fan 68 is operating.

This same sequential startup can be implemented for each of the remaining fans 72, 74, 76, 78, 80, 82. Of course, the fans need not be started in order of their numerical label, as shown in FIG. 7. Indeed, any of the fans could be the first to be started, while any of the other fans could be the second, third, etc. Starting the fans sequentially as described in this method, helps to reduce a large current draw which could be associated with starting eight fan motors simultaneously. Moreover, as noted above, it may not be necessary to operate each of the fans to provide adequate cooling; therefore, some of the fans may be started sequentially, while some of the other fans are not run at all. It is worth noting that in the fan and shroud assembly 66, shown in FIG. 7, divider walls are provided between each of the fans. For example, a divider wall 100 is disposed between the fans 80, 82. Depending on the configuration of the shroud, and in particular the divider walls, such as the wall 100, the air flow between and among each of the fans may be adequately separated, so that the counter rotational control of the fans described above may not be necessary. If the air flow generated by each of fans can be adequately separated from the air flow of each of the other fans, the undesirable interaction between the air flows, known to reduce efficiency, may be avoided.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A cooling system for a heat producing system in a vehicle, comprising:

a heat exchanger in fluid communication with the heat producing system and configured to receive a temperature control fluid therethrough;

a first fan operable in a first rotational direction to move air through the heat exchanger in a first direction;

a second fan disposed radially adjacent the first fan, the second fan being operable in a second rotational direction opposite the first rotational direction to move air through the heat exchanger in the first direction; and a control system for controlling operation of the fans and including at least one controller and a temperature sensor, the controller being configured to:

shut off when the vehicle is operating and the temperature of the al least one controller is greater than a first predetermined controller temperature, operate for a predetermined period of time after the vehicle is started, independently of the temperature of the at least one controller, and shut off after the predetermined period of time has elapsed and the temperature of the at least one controller is greater than the first predetermined controller temperature.

2. The cooling system of claim 1, further comprising:

a third fan operable in the first rotational direction to move air through the heat exchanger in the first direction; and a fourth fan disposed radially adjacent the third fan, the fourth fan being operable in the second rotational direction to move air through the heat exchanger in the first direction.

3. The cooling system of claim 1, wherein the control system is configured to selectively operate the first fan in the second rotational direction to move air through the heat exchanger in a second direction opposite the first direction, and wherein the control system is further configured to selectively operate the second fan in the first rotational direction to move air through the heat exchanger in the second direction.

4. The cooling system of claim 1, wherein the control system is configured to operate the first and second fans independently of each other.

5. The cooling system of claim 4, wherein the control system is further configured to start operation of the second fan only after the first fan has been operating for a first predetermined time.

6. The cooling system of claim 4, wherein the control system is further configured to determine when the first fan is operating, and the control system is configured to operate the second fan only after the control system determines that the first fan is operating.

7. A cooling system for a heat producing system in a vehicle subject to ram air when the vehicle is moving, the cooling system comprising:

a heat exchanger in fluid communication with the heat producing system and configured to receive a temperature control fluid therethrough;

a plurality of fans, each of the fans being disposed radially adjacent to at least one other of the fans, at least one of the fans being operable in a first rotational direction to move air through the heat exchanger in a first direction, and at least one other of the fans being operable in a second rotational direction opposite the first rotational direction to move air through the heat exchanger in the first direction; and a control system for controlling operation of the fans and including at least one controller, the control system being configured to:

selectively operate each of the fans in a rotational direction that facilitates movement of air by each of the fans through the heat exchanger in second direction opposite the first direction, operate each of the fans to move air through the heat exchanger in the first direction when the ram air speed is below a first predetermined speed, and operate each of the fans to move air through the heat exchanger in the second direction when the ram air speed is at or above the first predetermined speed.

8. The cooling system of claim 7, wherein each of the fans is operable to rotate in a direction opposite to the direction of rotation of at least one other of the fans disposed radially adjacent to it.

9. The cooling system of claim 7, wherein at least two of the fans radially adjacent to each other are configured to rotate in the same rotational direction to move air through the heat exchanger in the same direction.

10. The cooling system of claim 7, wherein the control system is configured to operate at least one of the fans independently of at least one other of the fans.

11. The cooling system of claim 10, wherein the control system is further configured to start operation of the fans sequentially, such that after a first one of the fans is started, another one of the fans is started only after a previously started fan has been operating for a first predetermined time.

12. The cooling system of claim 10, wherein the control system is further configured to determine when each of the fans is operating, and after the control system outputs a signal to start a first one of the fans, the control system outputs a signal to start another one of the fans only after the control system determines that a fan previously signaled to start is actually operating.

13. A method for cooling a heat producing system in a vehicle subject to ram air when the vehicle is moving, the heat producing system utilizing a heat exchanger and a plurality of fans, each of which is disposed radially adjacent at least one other of the fans, for moving air across the heat exchanger, the method comprising:

operating a first one of the fans in a first rotational direction to move air through the heat exchanger in a first direction;

operating a second one of the fans disposed radially adjacent the first fan in a second rotational direction opposite the first rotational direction to move air through the heat exchanger in the first direction operating the first in the second rotational direction to move air through the heat exchanger in a second direction opposite the first direction when the ram air speed is at or above a first predetermined speed; and operating the second fan in the first rotational direction to move air through the heat exchanger in the second direction when the ram air speed is at or above the first predetermined speed.

14. The method of claim 13, wherein the first and second fans are operated independently of each other.

15. The method of claim 13, wherein the second fan is operated only after the first fan has been operating for a first predetermined time.

16. The method of claim 13, further comprising verifying operation of the first fan, and wherein the second fan is operated only after operation of the first fan is verified.

* * * * *